US005234047A

United States Patent [19]

Rose

[11] Patent Number: 5,234,047

[45] Date of Patent: Aug. 10, 1993

[54] MOULD FOR CASTING COMPONENTS

[75] Inventor: Peter E. Rose, Burton-on-Trent, England

[73] Assignee: Rolls-Royce PLC, London, England

[21] Appl. No.: 941,892

[22] Filed: Sep. 8, 1992

[30] Foreign Application Priority Data

Oct. 9, 1991 [GB] United Kingdom ..... 9121364

[51] Int. Cl.[5] ..... B22D 43/00; B22D 25/00

[52] U.S. Cl. ..... 164/358; 164/350; 164/363

[58] Field of Search ..... 164/35, 122.1, 122.2, 164/134, 358, 34, 36, 122, 350, 352, 363

[56] References Cited

U.S. PATENT DOCUMENTS

| | | | |
|---|---|---|---|
| 3,724,531 | 4/1973 | Erikson et al. | 164/122.2 |
| 4,057,097 | 11/1977 | Lux et al. | 164/122.1 |
| 4,469,161 | 9/1984 | Higginbotham et al. | 164/134 |
| 5,072,771 | 12/1991 | Prasad | 164/122.1 |

FOREIGN PATENT DOCUMENTS

| | | |
|---|---|---|
| 1161805 | 8/1969 | United Kingdom . |
| 1303027 | 1/1973 | United Kingdom . |
| 1327992 | 8/1973 | United Kingdom . |
| 1426805 | 3/1976 | United Kingdom . |
| 1555742 | 11/1979 | United Kingdom . |

*Primary Examiner*—Kurt C. Rowan
*Assistant Examiner*—Erik R. Puknys
*Attorney, Agent, or Firm*—Oliff & Berridge

[57] ABSTRACT

A ceramic shell mould (70) for casting a single crystal turbine blade comprises a plurality of article portions, (72), each of which has an article chamber (74) for defining the shape of a turbine blade, a plurality of selector portions (76), a plurality of starter portions (80) and a runner portion (84). The runner portion (84) comprises a first subsection (86) which has a central axis (87) arranged parallel to, and spaced from, the central axes (73) of the article portions (72) and a plurality of second subsections (90) which interconnect the first subsection (86) with the article portions (72). The second subsections (90) are arranged to make an acute angle with the first subsection (86) of the runner portion (84) and with the starter portions (80) so that the second subsections (90) may bend to allow relative movement between the first subsection (86) and the starter portions (80) to prevent the cast turbine blades falling off the mould. The second subsections (90) also have a small cross-sectional area to increase the amount of bending possible.

22 Claims, 5 Drawing Sheets

MOULD FOR CASTING COMPONENTS

The present invention relates to moulds for casting components, and is particularly concerned with moulds used for lost wax casting, or investment casting, of components.

In the lost wax casting process a wax pattern of a component is produced The wax pattern is a replica of the component to be produced. Usually a number of wax patterns are assembled together on a wax gating tree to form a cluster or wax mould assembly. The wax mould assembly is immersed in a liquid ceramic slurry which quickly gels after draining, strengthening refractory granules are sprinkled over the ceramic slurry covered wax mould assembly and the refractory granules bond to the slurry coating to produce a ceramic layer on the wax mould assembly. This process is repeated several times to produce many ceramic layers which have a total thickness of about ¼ inch (6 mm) to ½ inch (12 mm) on the wax mould assembly. The wax is then melted out leaving a ceramic shell mould having an internal cavity identical in shape to that of the original wax cluster. This ceramic shell mould is called an investment casting mould. The mould is fired at a high temperature between 950° C. and 1100° C. to purify it by removing all traces of residual wax, while at the same time curing the ceramic mould. The ceramic shell mould is then transferred to a casting furnace, which may be operated at either vacuum conditions or at atmospheric conditions. A charge of molten metal is then poured into the ceramic shell mould and the mould is allowed to cool to room temperature, after which the ceramic shell mould is removed leaving the cast component or components. Normally the ceramic shell mould assembly and cast components are vibrated as a complete assembly to cause the ceramic shell mould to fall off the cast components. The individual components are then removed from the gating tree and are chemically processed to remove ceramic residue.

Accordingly the present invention seeks to provide a novel mould for casting components.

Accordingly the present invention provides a ceramic shell mould for casting a component comprising at least one article portion having an article chamber to define the desired component, the article portion having a central axis, a runner portion having a runner chamber to convey molten metal to the at least one article portion, the runner chamber including a first subsection having a central axis which is substantially parallel to, and spaced from, the central axis of the at least one article portion, a second subsection interconnecting the first subsection of the runner chamber and the at least one article portion, at least a part of the second subsection making an acute angle with any line parallel to the first subsection of the runner chamber or making an acute angle with any line parallel to the at least one article portion, at least one filter being positioned in the runner chamber such that any molten metal flowing from the runner chamber to the article chamber flows through the at least one filter from the first subsection to the at least one second subsection.

Preferably the mould comprises a plurality of article portions each having an associated article chamber to define a plurality of desired components, each article portion having a central axis, the central axis of the first subsection of the runner chamber being substantially parallel to, and spaced from, the central axes of the article portions, the runner chamber having a plurality of second subsections, each second subsection interconnecting the first subsection of the runner chamber with a respective one of the plurality of article portions, and a plurality of filters, each filter being arranged such that any molten metal flowing from the runner chamber to the article chambers flows through the filter from the first subsection to a respective one of the second subsections.

A mould for casting a single crystal component preferably comprises a selector portion connected to the article portion for selecting a single crystal from a plurality of directionally solidifying crystals in any molten metal in the mould, and a starter portion having a first end connected to the selector portion and a second open end for allowing directional solidification of crystals in molten metal in the starter portion of the mould, the second subsection of the runner chamber being connected to the starter portion.

A mould for casting a directionally solidified component preferably comprises a starter portion having a first end connected to the article portion and a second open end for allowing directional solidification of crystals in molten metal in the starter portion of the mould, the second subsection of the runner chamber being connected to the starter portion.

Preferably the second subsection of the runner chamber has a relatively small cross-section to allow bending of the second subsection.

Preferably the dimension of the cross-section of the second subsection is 6 mm or less.

Preferably the second subsection has a circular cross-section.

The second subsection of the runner chamber may extend in a straight line, or may extend in a curved line.

Preferably a filter is positioned in the first subsection of the runner chamber. The filter may be positioned immediately before the interconnection of the first and second subsections of the runner chamber.

A number of the plurality of second subsections interconnect with the first subsection at a first axial location of the first subsection of the runner chamber.

A number of the plurality of second subsections interconnect with the first subsection at a second axial location spaced axially from the first axial location of the first subsection of the runner chamber.

The present invention also provides a ceramic shell mould for casting a single crystal component comprising at least one article portion having an article chamber to define the desired component, a selector portion connected to the article portion for selecting a single crystal from a plurality of directionally solidifying crystals in molten metal in the mould, a starter portion having a first end connected to the selector portion and a second open end for allowing directional solidification of crystals in molten metal in the starter portion of the mould, a runner portion having a runner chamber to convey molten metal to the at least one article portion, the runner chamber including a first subsection having a central axis which is substantially parallel to, and spaced from, the central axis of the at least one article portion, and a second subsection interconnecting the first subsection of the runner chamber and the at least one article portion, the second subsection of the runner chamber being connected to the starter portion, at least a part of the second subsection making an an acute angle with any line parallel to the first subsection of the runner chamber or making an acute angle with any line parallel to the at least one article portion to allow relative movement between the first subsection of the runner chamber and the at least one article portion.

The starter portion may have a relatively small cross-section. The starter portion may have a diameter in the range of 4 mm to 10 mm. The starter portion may have a relatively small height. The starter portion may have a height in the range of 10 mm to 20 mm.

The present invention also provides a method of making a ceramic shell mould for casting a component comprising (a) constructing a wax pattern of the component, the pattern having the required dimensions of the component, (b) assembling the pattern in a wax mould assembly, the wax mould assembly having a wax runner comprising a first subsection and a second subsection, the second subsection interconnecting the first subsection of the wax runner and the wax pattern, at least part of the second subsection making an acute angle with any line parallel to the first subsection of the wax runner or making an acute angle with any line parallel to the wax pattern, (c) locating a filter in the wax runner at a position between the first subsection and the second subsection, (d) applying ceramic material in layers to the exterior of the wax mould assembly to form a ceramic shell mould, (e) removing the wax from the interior of the ceramic shell mould.

Wherein where the ceramic shell mould is for casting single crystal components the wax pattern comprises a wax selector part and a wax starter part, the second subsection of the wax runner is interconnected to the wax selector part.

The present invention will be more fully described by way of example, with reference to the accompanying drawings in which FIG. 1 is a view of a wax mould assembly for making a mould according to the present invention.

Figure 1:
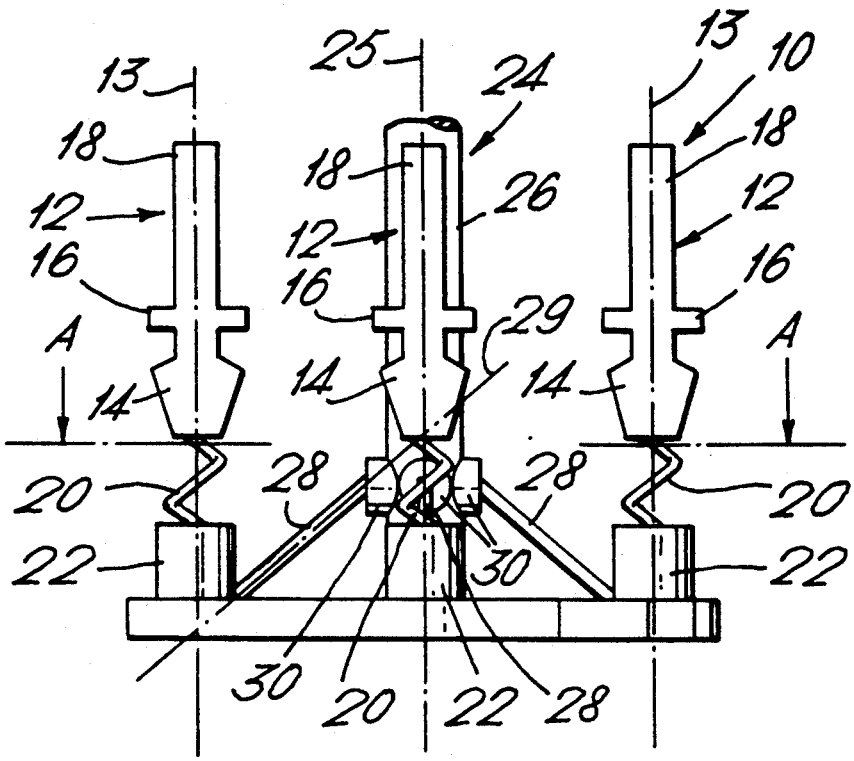
Figure 2:
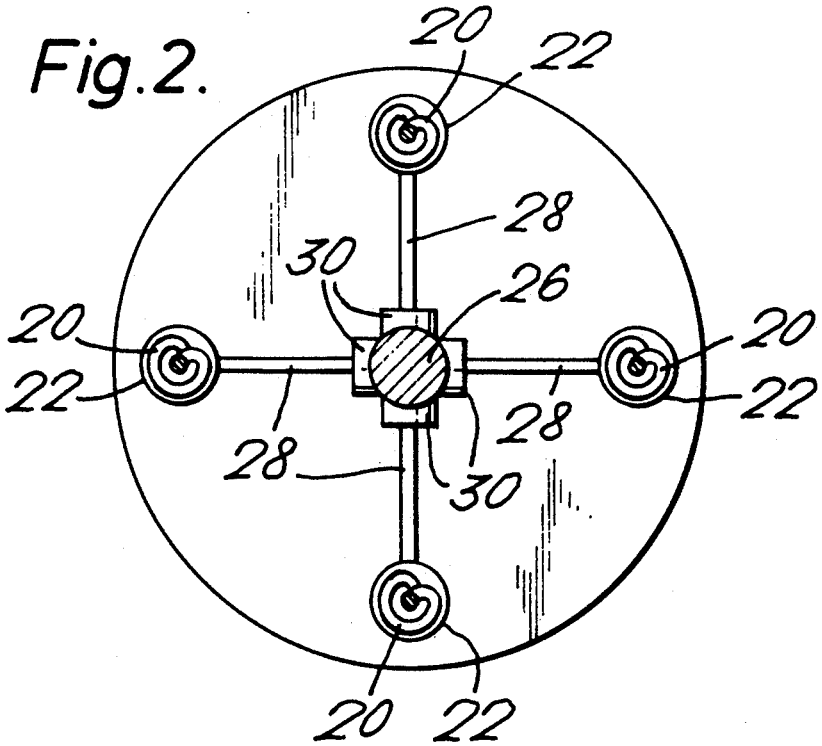
FIG. 2 is a cross-sectional view in the direction of arrows A in FIG. 1.

A wax mould assembly 10, shown in FIGS. 1 and 2, comprises a plurality of wax patterns 12 suitable for making turbine blades or turbine vanes for gas turbine engines. Each of the wax patterns 12 has a first part 14, which defines the shape of the root of the resulting cast turbine blade, a second part 16, which defines the shape of the platform of the cast turbine blade and a third part 18, which defines the shape of the aerofoil of the resulting cast turbine blade. The turbine blades to be cast in this example are single crystal turbine blades and therefore an associated wax selector part 20 and wax starter part 22 are connected to each wax pattern 12 The wax selector part 20 in this example is a wax helix, although other suitable selectors may be used. The wax patterns 12 and associated wax selectors 20 and wax starters 22 are arranged together on a wax gating tree 24 to form the wax mould assembly 10. The wax gating tree 24 comprises a wax runner which includes a first subsection 26 and a plurality of second subsections 28. The central axes 13 of the wax patterns 12 are arranged substantially parallel to, and spaced from, the central axis 25 of the first subsection 26 of the wax gating tree 24. Each second subsection 28 of the wax gating tree 24 interconnects the first subsection of the wax gating tree 24 and a respective one of the wax starters 22. The central axes 29 of the second subsections 28 make an acute angle with both the first subsection 26 of the wax gating tree 24 and the wax starter 22. The wax gating tree 24 also includes a plurality of ceramic filters 30, one for each second subsection 28, which are positioned in the first subsection 26 immediately before the second subsections 28. The second subsections 28 extend in a straight line in this example.

The wax mould assembly 10, including the wax patterns 12, is immersed in liquid ceramic slurry and has refractory granules sprinkled on the gelling liquid ceramic slurry to produce a layer of ceramic. The process of immersing the wax mould assembly 10 in liquid ceramic slurry and sprinkling with refractory granules is repeated until the thickness of ceramic is sufficient for the particular application. The thickness of ceramic normally used is 6 mm to 12 mm.

Figure 5:
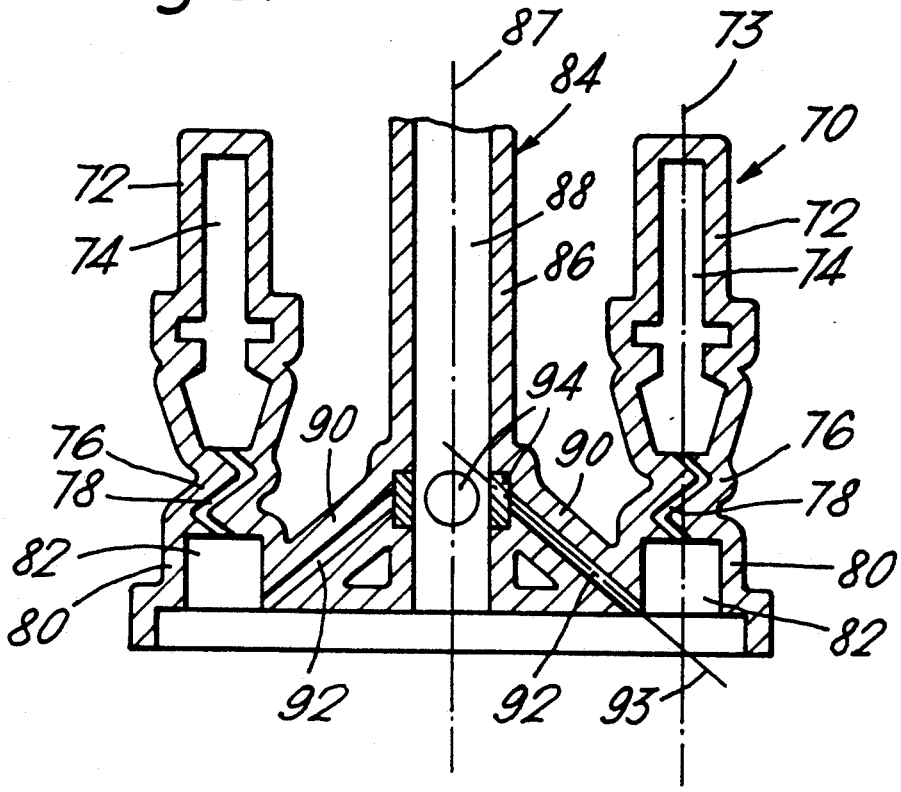
FIG. 5 is a cross-sectional view through a mould according to the present invention using the wax mould assembly shown in FIGS. 1 and 2.

FIG. 5 shows a ceramic shell mould 70 for casting a single crystal turbine blade made from the wax mould assembly 10 shown in FIGS. 1 and 2 The ceramic shell mould 70 comprises a plurality of article portions 72 each of which has an article chamber 74 to define the turbine blade. Each of the article portions 72 of the ceramic shell mould 70 has an associated selector portion 76, which has a selector passage 78, and an associated starter portion 80, which has a starter chamber 82. Each selector passage 78 is connected to its associated article chamber 74, a first end of each starter chamber 82 is connected to its associated selector passage 78 and a second end of each starter chamber 82 is open. The ceramic shell mould 70 also comprises a runner portion 84 to convey molten metal to the article portions 72 via the starter and selector portions 80 and 82 respectively The runner portion 84 includes a single first subsection 86, which has a first runner passage 88, and a plurality of second subsections 90, which have second runner passages 92. The first subsection 86 has a central axis 87 which is substantially parallel to, and spaced from, the central axis 73 of the article portions 72. The second subsections 90 interconnect the first subsection 86 of the runner portion 84 to each of the article portions 72. The second subsections 90 of the runner portion 84 have a central axis 93 which makes an acute angle with the first subsection 86 of the runner portion 84 and which make an acute angle with each of the article portions 72. A plurality of ceramic filters 94 are provided in the runner portion 84 within the first subsection 86 to filter the molten metal as it is conveyed to the article portions 72. The second runner passages 92 of the second subsections 90 of the runner portion 84 have a relatively small cross-section to allow bending of the second subsections 90. The dimension of the cross-section of the passages 92 of the second subsections 90 is 6 mm or less. In this example the second subsections 90 have a circular cross-section. The ceramic shell mould 70 has a recess 96 which is arranged to fit on a chill plate during the single crystal casting process.

When molten metal is poured into the ceramic shell mould 70, the molten metal flows through the first runner passage 88, the ceramic filters 94 and the second runner passages 92 to the starter chambers 82. The molten metal then flows upwardly through the starter chambers 82 and the selector passages 78 into the article chambers 74. In the single crystal casting process the second open ends of the starter chambers 82 of the ceramic shell mould 70 are placed onto a chill plate located in the recess 96 of the ceramic shell mould 70. The chill plate causes solidification of the molten metal to occur, and the chill plate and ceramic shell mould 70 are withdrawn slowly from the casting furnace to produce directional solidification of the molten metal within the starter chamber 82 of the ceramic shell mould 70. The selector passage 78 selects a single crystal from a plurality of directionally solidifying crystals in the starter chamber 82 of the ceramic shell mould 70.

The provision of the second subsections 90 of the runner portions 84 allows the filters 94 to be placed at the intersections of the first subsection 86 with each of the second subsections 90, and the molten metal is filtered as it flows from the first subsection 90 into each of the second subsections 90. This enables the dimensions of the starter portion 22 i.e. height and diameter, or width and length, to be minimised. This also makes it possible, in circumstances when smaller sized components are being produced, to have more article portions per mould assembly. This also allows the fitting of larger, axially longer, components on the mould assembly. The use of these second subsections 90 only uses a small amount of additional metal, because they only have a small cross-section. The use of starter portions 22 with smaller dimensions does not materially effect the quality of the finished single crystal components, furthermore the smaller starter portions use less metal resulting in less scrap metal. Each starter portion 22 in FIG. 5 has a conventional, uniform diameter of approximately 18.5 mm throughout its height and a height of 25–30 mm.

A problem associated with the casting of single crystal components using the lost wax casting process, is that some of the cast components fall off the mould assembly after casting. It is difficult to remove the ceramic shell from cast single crystal components which have fallen off the mould assembly. These cast single crystal components may be damaged during the removal of the ceramic shell, and they may be subject to re-crystallisation during the removal of the ceramic shell Either of these occurrences will result in the scrapping of the cast single crystal component.

Another problem is that conventional techniques to prevent the cast components falling off the mould assembly after casting has resulted in parts of the mould assembly becoming too strong and weaker parts of the mould assembly have split to allow molten metal to run out. One conventional technique to prevent the cast components falling off the mould is to provide a wax disc at the bottom of the first subsection of the runner where the purely radial horizontal second subsections feed the article portions. In this technique the resulting disc chamber and radial second subsections are in tension during casting but are unable to split, instead the article portions split and allow molten metal to flow out.

The second subsections 90 of the ceramic shell mould 70 have the ability to allow relative movement between the first subsection 86 of the runner portion 84 and the article portions 74 when under tension during casting of the metal in the ceramic shell mould 70 Because the second subsections 90 of the ceramic shell mould 84 are arranged at an acute angle to the first subsection 86 of the runner portion 84 and at an acute angle to the starter portion 80, and because the second subsections 90 have a relatively small cross-section, the second subsections 90 are able to bend when under tension during casting of the ceramic shell mould 70. The use of second subsections 90 with relatively small cross-sections increases their ability to bend. The use of these second subsections 90 prevents or reduces the possibility of the cast single crystal components falling off the resulting cast assembly and prevents or reduces the possibility of splitting of the ceramic shell mould 70 during the casting process.

Figure 3:
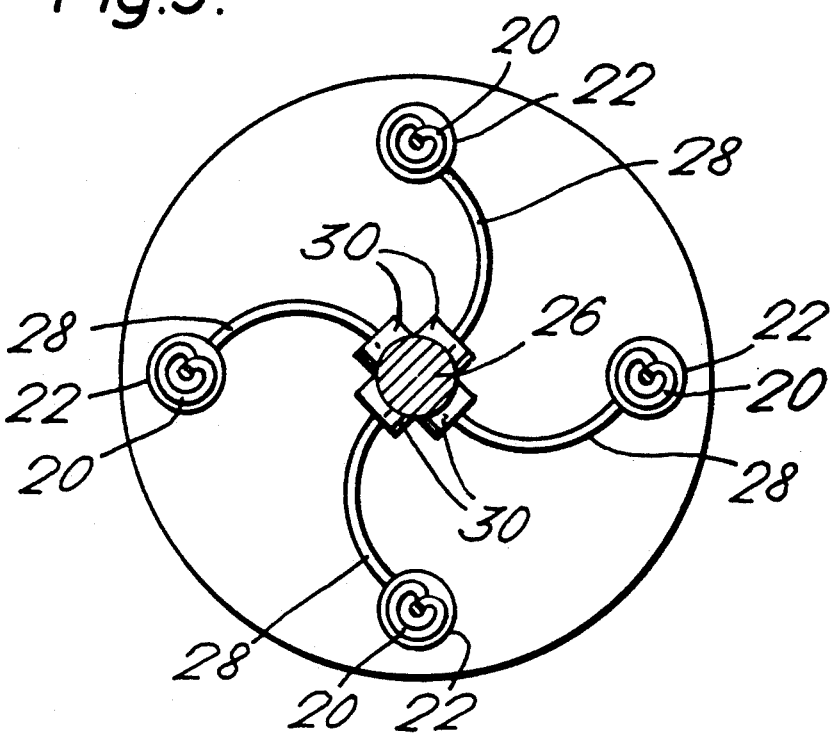
FIG. 3 is a cross-sectional view in the direction of arrows A in FIG. 1 showing an alternative arrangement.

In FIG. 3 an alternative arrangement for the second subsections 28 of the wax gating tree 24 is shown. The second subsections 28 of the wax gating tree 24 are curved in this example and this results in curved second runner passages and curved second subsections of the runner portion of the ceramic shell mould. These curved second runner passages and second subsections of the ceramic shell mould allow greater bending to occur.

Figure 4:
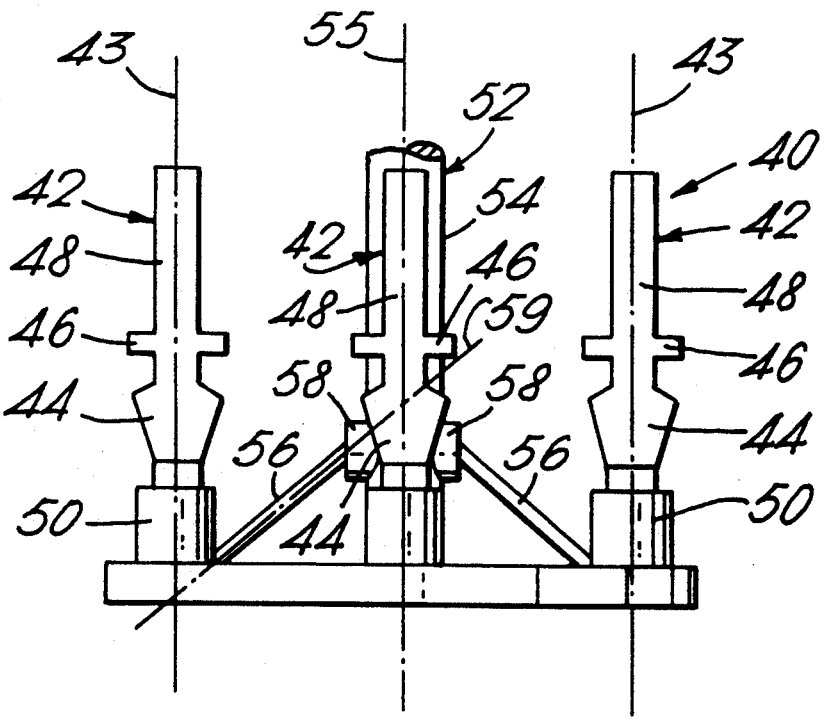
FIG. 4 is a view of an alternative wax mould assembly for making an alternative mould according to the present invention.

A wax mould assembly 40, shown in FIG. 4, comprises a plurality of wax patterns 42 suitable for making turbine blades or turbine vanes for gas turbine engines. Each of the wax patterns 42 has a first part 44, which defines the shape of the root of the resulting cast turbine blade, a second part 46, which defines the shape of the platform of the cast turbine blade and a third part 48, which defines the shape of the aerofoil of the resulting cast turbine blade. The turbine blades to be cast in this example are directionally solidified turbine blades and therefore an associated wax starter part 50 is connected to each wax pattern 42. The wax patterns 42 and associated wax starters 42 are arranged together on a wax gating tree 52 to form the wax mould assembly 40. The wax gating tree 52 comprises a wax runner which includes a first subsection 54 and a plurality of second subsections 56. The central axes 43 of the wax patterns 42 are arranged substantially parallel to, and spaced from, the central axis 55 of the first subsection 54 of the wax gating tree 52. Each second subsection 56 of the wax gating tree 52 interconnects the first subsection 54 of the wax gating tree 52 and a respective one of the wax starters 50. The central axes 59 of the second subsections 56 make an acute angle with both the first subsection 54 of the wax gating tree 52 and the wax starter 50. The wax gating tree 52 may also include a plurality of ceramic filters 60, one for each second subsection 56, which are positioned in the first subsection 54 immediately before the second subsections 56. The second subsections 56 extend in a straight line in this example.

The wax mould assembly 40, including the wax patterns 42, is immersed in liquid ceramic slurry and has refractory granules sprinkled on the gelling liquid ceramic slurry to produce a layer of ceramic. The process of immersing the wax mould assembly 40 in liquid ceramic slurry and sprinkling with refractory granules is repeated until the thickness of ceramic is sufficient for the particular application. The thickness of ceramic normally used is 6 mm to 12 mm.

Figure 6:
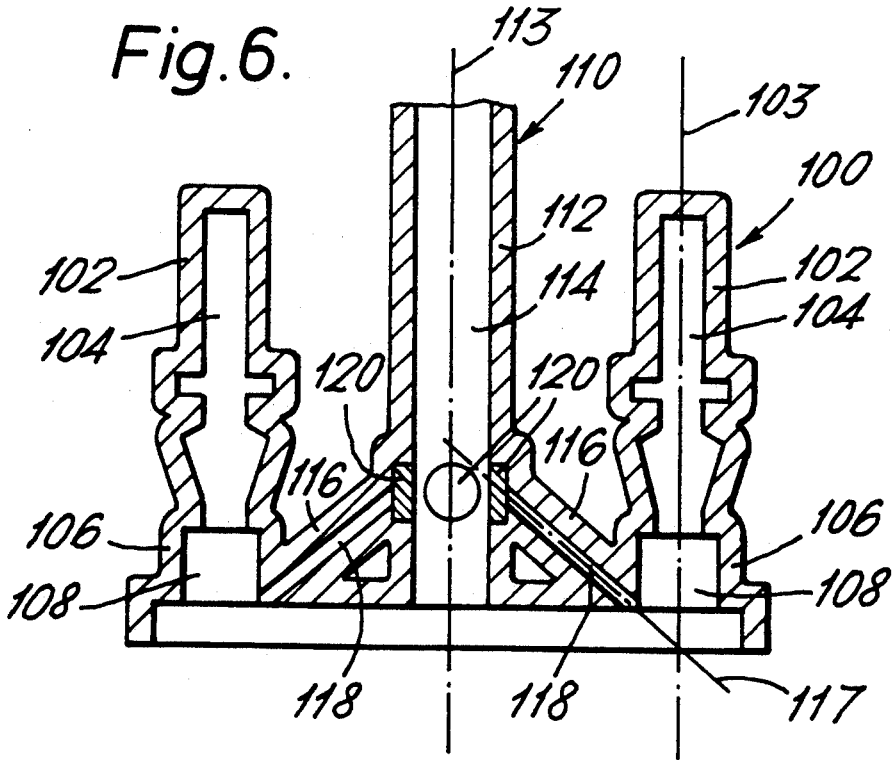
FIG. 6 is a cross-sectional view through a mould according to the present invention using the wax mould assembly shown in FIG. 4.

FIG. 6 shows a ceramic shell mould 100 for casting a single crystal turbine blade made from the wax mould assembly 40 shown in FIG. 4 The ceramic shell mould 100 comprises a plurality of article portions 102 each of which has an article chamber 104 to define the turbine blade. Each of the article portions 102 of the ceramic shell mould 100 has an associated starter portion 106, which has a starter chamber 108. A first end of each starter chamber 108 is connected to its associated article chamber 104 and a second end of each starter chamber 108 is open. The ceramic shell mould 100 also comprises a runner portion 110 to convey molten metal to the article portions 102 via the starter portions 106 respectively. The runner portion 110 includes a single first subsection 112, which has a first runner which have second runner passages 118. The first subsection 112 has a central axis 113 which is substantially parallel to, and spaced from, the central axis 103 of the article portions 102. The second subsections 116 interconnect the first subsection 112 of the runner portion 110 to each of the article portions 102 The second subsections 116 of the runner portion 110 have a central axis 1117 which makes an acute angle with the first subsection 112 of the runner portion 110 and which makes an acute angle with each of the article portions 102. A plurality of ceramic filters 120 are provided in the runner portion 110 within the first subsection 112 to filter the molten metal as it is conveyed to the article portions 102. The second runner passages 118 of the second subsections 116 of the runner portion 110 have a relatively small cross-section to allow bending of the second subsections 116. The dimension of the cross-section of the passages 118 of the second subsections 116 is 6 mm or less. In this example the second subsections 116 have a circular cross-section. The ceramic shell mould 100 has a recess 122 which is arranged to fit on a chill plate during the directional solidification process.

When molten metal is poured into the ceramic shell mould 100, the molten metal flows through the first runner passage 112, the ceramic filters 120 and the second runner passages 118 to the starter chambers 108. The molten metal then flows upwardly through the starter chambers 108 into the article chambers 104. In the directional solidification casting process the second open ends of the starter chambers 108 of the ceramic shell mould 100 are placed onto a chill plate located in the recess 122 of the mould 100. The chill plate causes solidification of the molten metal to occur, and the chill plate and the ceramic shell mould 100 are withdrawn slowly from the casting furnace to produce directional solidification of the molten metal within the starter chambers 108 of the ceramic shell mould 100 which continues into the article portion 104 of the ceramic shell mould 100.

The provision of the second subsections 116 of the runner portions 110 allows the filters 120 to be placed at the intersections of the first subsection 112 with each of the second subsections 116, and the molten metal is filtered as it flows from the first subsection 112 into each of the second subsections 116 This enables the dimensions of the starter portions 108, i.e. height and diameter, or width and length, to be minimised This also makes it possible, in circumstances when smaller sized components are being produced, to have more article portions per mould assembly. This also allows the fitting of larger, axially longer, components on the mould assembly. The use of these second subsections 116 only uses a small amount of additional metal, because they only have a small cross-section.

The second subsections 116 of the ceramic shell mould 100 have the ability to allow relative movement between the first subsection 112 of the runner portion 110 and the article portions 104 when under tension during casting of the metal in the ceramic shell mould 100. Because the second subsections 116 of the ceramic shell mould 100 are arranged at an acute angle to the first subsection 112 of the runner portion 110 and at an acute angle to the starter portion 106 and because the second subsections 116 have a relatively small cross-section, the second subsections 116 are able to bend when under tension during casting of the ceramic shell mould 100. The use of second subsections 116 with relatively small cross-sections increases their ability to bend.

Figure 7:
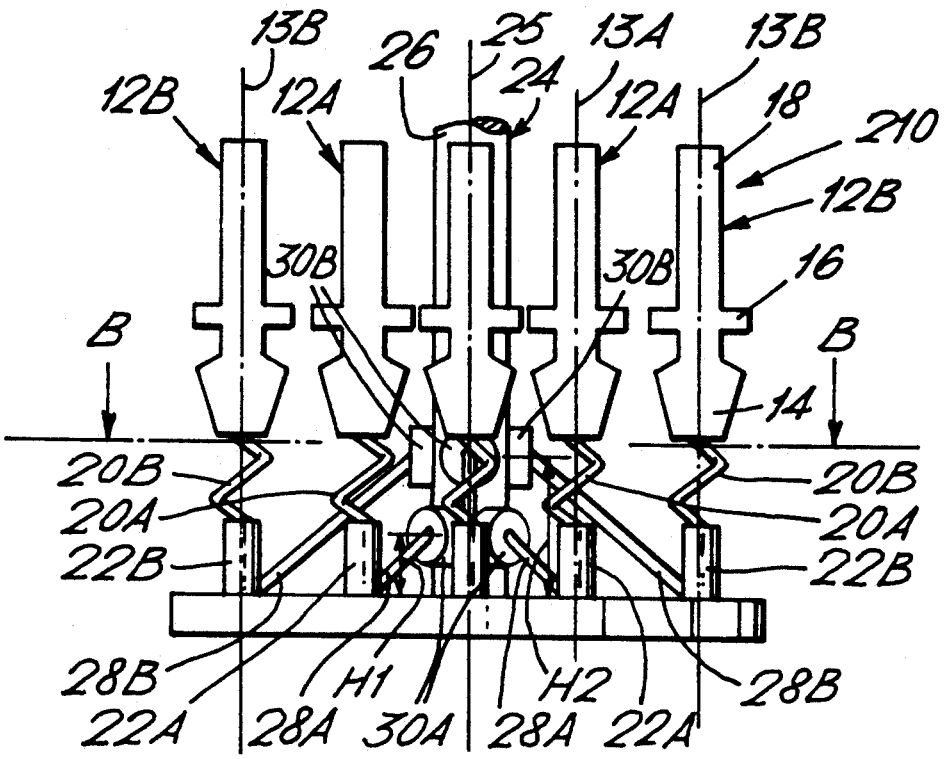
FIG. 7 is a view of a further alternative wax mould assembly for making a mould according to the present invention.
Figure 8:
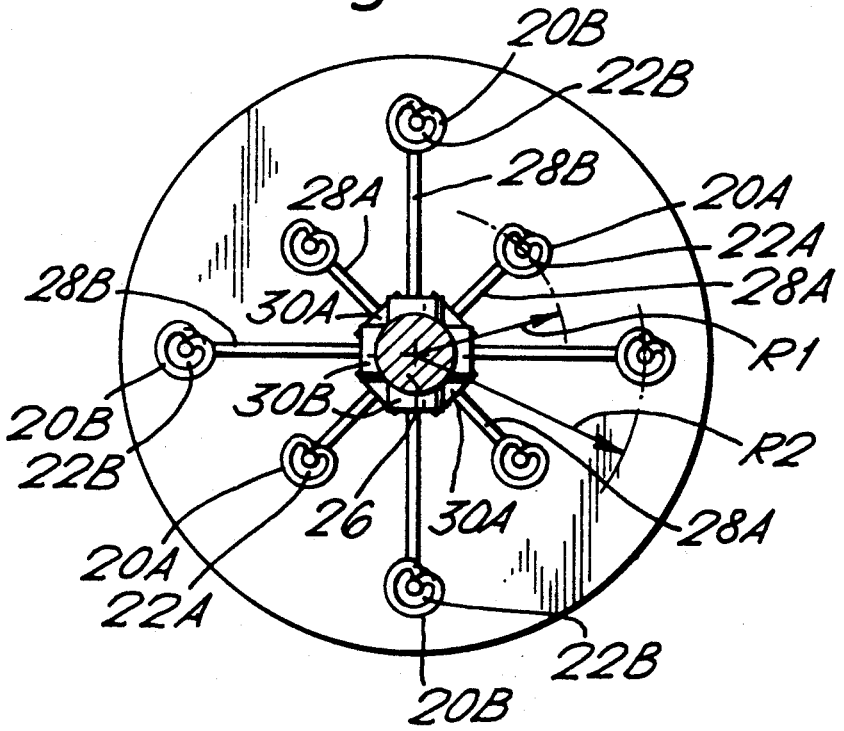
FIG. 8 is a cross-sectional view in the direction of arrows B in FIG. 7.

A further wax mould assembly 210, shown in FIGS. 7 and 8, is similar to that shown in FIGS. 1 and 2 and comprises a plurality of wax patterns 12A,12B suitable for making turbine blades or turbine vanes for gas turbine engines. Each of the wax patterns 12A,12B has a first part 14, which defines the shape of the root of the resulting cast turbine blade, a second part 16, which defines the shape of the platform of the cast turbine blade and a third part 18, which defines the shape of the aerofoil of the resulting cast turbine blade. The turbine blades to be cast in this example are single crystal turbine blades and therefore an associated wax selector part 20A,20B and wax starter part 22A,22B are connected to the respective wax pattern 12A,12B. The wax selector parts 20A,20B in this example is a wax helix, although other suitable selectors may be used. The wax patterns 12A,12B and associated wax selectors 20A,20B and wax starters 22A,22B are arranged together on a wax gating tree 24 to form the wax mould assembly 210 The wax gating tree 24 comprises a wax runner which includes a first subsection 26 and a plurality of second subsections 28. The central axes 13A,13B of the wax patterns 12A,12B are arranged substantially parallel to, and spaced from, the central axis 25 of the first subsection 26 of the wax gating tree 24. Each second subsection 28 of the wax gating tree 24 interconnects the first subsection 26 of the wax gating tree 24 and a respective one of the wax starters 22A,22B. The central axes 29 of the second subsections 28A,28B make an acute angle with both the first subsection 26A,26B of the wax gating tree 24 and the wax starter 22A,22B The wax gating tree 24 also includes a plurality of ceramic filters 30A,30B, one for each second subsection 28A,28B, which are positioned in the first subsection 26 immediately before the second subsections 28A,28B. The second subsections 28A,28B extend in a straight line in this example.

The wax mould assembly 210 differs from that shown in FIGS. 1 and 2, in that the wax starters 22A,22B have a smaller diameter, than that of the wax starters 22 in FIGS. 1 and 2. Also the central axes 13A of a number of the wax patterns 12A are arranged a first radial distance R1 from the central axis 25 of the first subsection 26 of the wax gating tree 24, and the central axes 13B of a number of the wax patterns 12B are arranged at a second larger radial distance R2 from the central axis 25 of the wax gating tree 24. Furthermore a number of the filters 30A, those interconnected to the wax patterns 12A which have their central axes 13A arranged at the first radial distance R1, are arranged at a first axial distance H1 along the first subsection 26 of the wax gating tree 24, and a number of the filters 30B, those interconnected to the wax patterns 12B which have their central axes 13B arranged at the second radial distance R2, are arranged at a second larger axial distance H2 along the first subsection 26 of the wax gating tree 24 The wax patterns 12A are arranged circumferentially alternately with the wax patterns 12B and the filters 30A are arranged circumferentially alternately with the filters 30B Thus this wax mould assembly has a greater number of wax patterns than the wax mould assembly in FIGS. 1 and 2.

The wax mould assembly 210, including the wax patterns 12A and 12B, is immersed in liquid ceramic slurry and has refractory granules sprinkled on the gelling liquid ceramic slurry to produce a layer of ceramic. The process of immersing the wax mould assembly 210 in liquid ceramic slurry and sprinkling with refractory granules is repeated until the thickness of ceramic is sufficient for the particular application The thickness of ceramic normally used is 6 mm to 12 mm.

Figure 9:
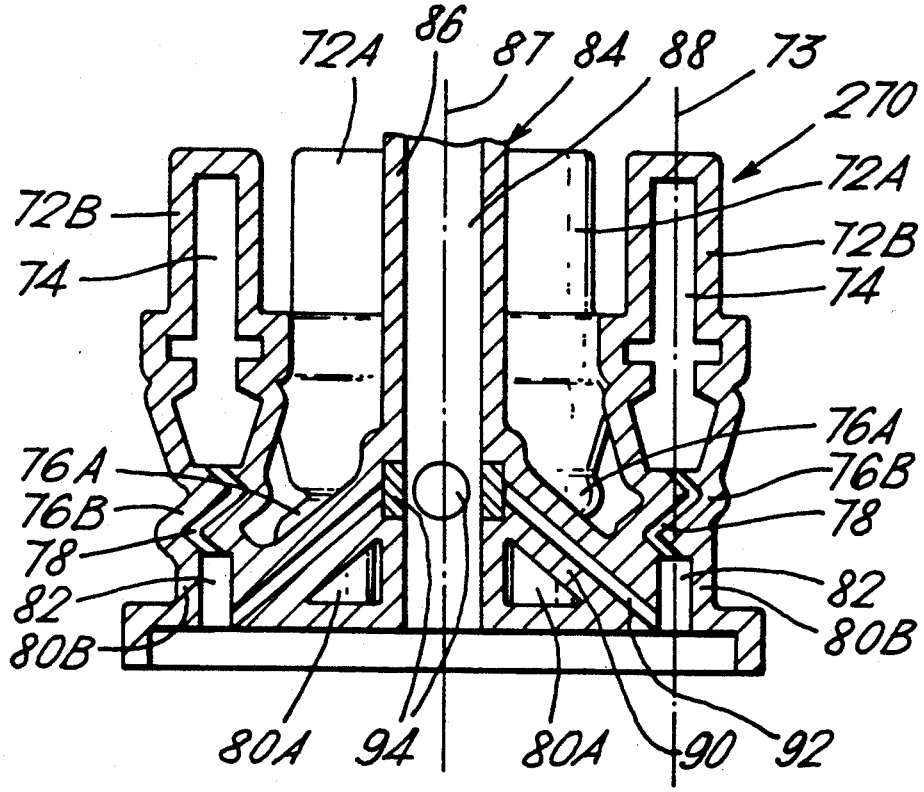
FIG. 9 is a cross-sectional view through a mould using the wax mould shown in FIGS. 7 and 8.

FIG. 9 shows a ceramic shell mould 270 for casting a single crystal turbine blade made from the wax mould assembly 210 shown in FIGS. 7 and 8. The ceramic shell mould 270 comprises a plurality of article portions 72A,72B each of which has an article chamber 74 to define the turbine blade. Each of the article portions 72A,72B of the ceramic shell mould 270 has an associated selector portion 76A,76B which has a selector passage 78 and an associated starter portion 80A,80B which has a starter chamber 82. Each selector passage 78 is connected to its associated article chamber 74, a first end of each starter chamber 82 is connected to its associated selector passage 78 and a second end of each starter chamber 82 is open. The ceramic shell mould 270 also comprises a runner portion 84 to convey molten metal to the article portions 72 via the starter and selector poritons 80 and 82 respectively. The runner portion 84 includes a single first subsection 86, which has first runner passage 88, and a plurality of second subsections 90, which have second runner passages 92. The first subsection 86 has a central axis 87 which is substantially parallel to, and spaced from, the central axis 73 of the article portions 72. The second subsections 90 interconnect the first subsection 86 of the runner portion 84 to each of the article portions 72. The second subsections 90 of the runner portion 84 have a central axis g3 which makes an acute angle with the first subsection 86 of the runner portion 84 and which make an acute angle with each of the article portions 72 A plurality of ceramic filters 94 are provided in the runner portion 84 within the first subsection 85 to filter the molten metal as it is conveyed to the article portions 72. The second runner passages 92 of the second subsections 90 of the runner portion 84 have a relatively small cross-section to allow bending of the second subsections 90. The dimension of the cross-section of the passages 92 of the second subsections 90 is 6 mm or less. In this example the second subsections 90 have a circular cross-section. The ceramic shell mould 70 has a recess 96 which is arranged to fit on a chill plate during the single crystal casting process.

The provision of the second subsections 90 of the runner portions 84 allows the filters 94 to be placed at the intersections of the first subsection 86 with each of the second subsections 90, and the molten metal is filtered as it flows from the first subsection 90 into each of the second subsections 90.

The ceramic shell mould assembly 270 differs from that shown in FIG. 4, in that the starter portions 80 have a smaller diameter, than that of the starter portions in FIG. 4. Each starter portion 80 has a uniform diameter of 4 mm to 10 mm, for example 7 mm, or at least the diameter of the passage in the selector portion, throughout its height. Each starter portion has a height of 10 mm to 20 mm for example 17 mm. The smaller dimensions of the starter portions does not materially effect the quality of the finished single crystal components, furthermore there is less scrap metal. Other suitable diameters and heights may be used for the starter portions Also the central axes 73 of a number of the article portions 72A are arranged at a first radial distance R1 from the central axis 87 of the first subsection 86 of the runner portion 84, and the central axis 73 of a number of the article portions 72B are arranged at a second larger radial distance R2 from the central axis 87 of the runner portion portion 84. Furthermore a number of the filters 94, those interconnected to the wax patterns 72A which have their central axes 73 arranged at the first radial distance R1, are arranged at a first axial distance H1 along the first subsection 86 of the runner portion 84, and a number of the filters 94, those interconnected to the wax patterns 72B which have their central axes 73 arranged at the second radial distance R2, are arranged a second larger axial distance H2 along the first subsection 86 of the runner portion 84. The article portions 72A are arranged circumferentially alternatively with the article portions 72B and their respective filters 30 are arranged circumferentially alternately. Thus the ceramic shell mould 270 has a greater number of article portions than the ceramic shell mould in FIG. 4.

It is also possible to minimise the height of the starter portion 80, and the reduction in height of the starter portion 80 enables single crystal components with greater axial lengths to be cast on the ceramic shell mould using the same casting furnace.

Although the description has referred to second subsections of the runner portion of the ceramic shell mould having circular cross-sections other suitable cross-sections may be used.

I claim:

1. A ceramic shell mold for casting a component comprising at least one article portion, a runner portion, and at least one filter, the article portion having a central axis and an article chamber to define the desired component, the runner portion having a runner chamber to convey molten metal to the at least one article portion, the runner chamber including a first subsection and a second subsection, the first subsection having a central axis which is substantially parallel to, and spaced from, the central axis of the at least one article portion, the second subsection interconnecting the first subsection of the runner chamber and the at least one article portion, at least a part of the second subsection making an acute angle with any line parallel to the central axis of the first subsection of the runner chamber or making an acute angle with any line parallel to the central axis of the at least one article portion, the second subsection having a cross-section of a dimension of 6 mm or less, the at least one filter being positioned in the runner chamber such that any molten metal flowing from the runner chamber to the article chamber flows through the at least one filter from the first subsection to the second subsection of the runner portion.

2. A ceramic shell mold as claimed in claim 1 in which the mould comprise a plurality of article poritons each having an associated article chamber to define a plurality of desired components, each article portion having a central axis, the central axis of the first subsection of the runner chamber being substantially parallel to, and spaced from, the central axes of the article portions, the runner chamber having a plurality of second subsections, each second subsection interconnecting the first subsection of the runner chamber with a respective one of the plurality of article poritons, and a plurality of filters, each filter being arranged such that molten metal flowing from the runner chamber to the article chamber flows through the respective filter from the first subsection to a respective one of the second subsections.

3. A ceramic shell mold as claimed in claim 1 for casting a single crystal component comprising a selection portion connected to the article portion for selecting a single crystal from a plurality of directionally solidifying crystals in any molten metal in the mould, and a starter portion having a first end connected to the selector portion and a second open end for allowing directional solidification of crystals in molten metal in the starter portion of the mould, the second subsection of the runner chamber being connected to the starter portion.

4. A ceramic shell mold as claimed in claim 1 for casting a directionally solidified component comprising a starter portion having a first end connected to the article portion and a second open end for allowing directional solidification of crystals in molten metal in the starter portion of the mould, the second subsection of the runner chamber being connected to the starter portion.

5. A ceramic shell mold as claimed in claim 1 in which the second subsection has a circular cross-section.

6. A ceramic shell mold as claimed in claim 1 in which the second subsection of the runner chamber extends in a straight line.

7. A ceramic shell mold as claimed in claim 1 in which the second subsection of the runner chamber extends in a curved line.

8. A ceramic shell mold as claimed in claim 1 in which a filter is positioned in the first subsection of the runner chamber.

9. A ceramic shell mold as claimed in claim 8 in which the filter is positioned immediately before the interconnection of the first and second subsections of the runner chamber.

10. A ceramic shell mold as claimed in claim 2 in which a number of the plurality of second subsections interconnect with the first subsection at a first axial location of the first subsection of the runner chamber.

11. A ceramic shell mold as claimed in claim 10 in which a number of the plurality of second subsections interconnect with the first subsection at a second axial location spaced axially from the first axial location of the first subsection of the runner chamber.

12. A ceramic shell mold as claimed in claim 3 in which the starter portion has a diameter in the range of 4 mm to 10 mm.

13. A ceramic shell mold as claimed in claim 3 in which the starter portion has a height in the range of 10 mm to 20 mm.

14. A ceramic shell mold for casting a single crystal component, comprising at least one article portion having an article chamber to define the desired component, the article portion having a central axis, a selector portion connected to the article portion for selecting a single crystal from a plurality of directionally solidifying crystals in molten metal in the mold, a starter portion having a first end connected to the selector portion and a second open end for allowing directional solidification of crystals in molten metal in the starter portion of the mold, the starter portion having a height in the range of 10 mm to 20 mm, a runner portion having a runner chamber to convey molten metal to the at least one article portion, the runner chamber including a first subsection having a central axis which is substantially parallel to, and spaced from, the central axis of the at least one article portion, and a second subsection interconnecting the first subsection of the runner chamber and the at least one article portion, the second subsection of the runner chamber being connected to the starter portion, at least a part of the second subsection making an acute angle with any line parallel to the central axis of the first subsection of the runner chamber or making an acute angle with any line parallel to the central axis of the at least one article portion to allow relative movement between the first subsection of the runner chamber and the at least one article portion.

15. A ceramic shell mold as claimed in claim 14 in which a filter is positioned in the runner chamber such that molten metal flows through the filter from the first subsection to the second subsection.

16. A ceramic shell mold as claimed in claim 14 in which the second subsection of the runner chamber has a cross-section having a dimension of 6 mm or less.

17. A ceramic mold as claimed in claim 14 in which the second subsection of the runner chamber extends in a straight line.

18. A ceramic shell mold a claimed in claim 14 in which the starter portion has a diameter in the range of 4 mm to 10 mm.

19. A ceramic shell mold for casting a component, comprising at least one article portion, a runner portion, at least one filter, a selector portion connected to the article portion for selecting a single crystal from a plurality of directionally solidifying crystals in any molten metal in the mold, and a starter portion having a first end connected to the selector portion and a second open end for allowing directional solidification of crystals in molten metal int he starter portion of the mold, the starter portion having a diameter in the range of 4 mm to 10 mm, the second subsection of the runner chamber being connected to the starter portion, the article portion having a central axis and an article chamber to define the desired component, the runner portion having a runner chamber to convey molten metal to the at least one article portion, the runner chamber including a first subsection and a second subsection, the first subsection having a central axis which is substantially parallel to, and spaced from, the central axis of the at least one article portion, the second subsection interconnecting the first subsection of the runner chamber and the at least one article portion, at least a part of the second subsection making an acute angle with any lien parallel to the central axis of the first subsection of the runner chamber or making an acute angle with any line parallel to the central axis of the at least one article portion, the at least one filter being positioned in the runner chamber such that nay molten metal flowing from the runner chamber to the article chamber flows through the at least one filter from the first subsection to the second subsection of the runner portion.

20. A ceramic shell mold for casting a component, comprising at least one article portion, a runner portion, at least one filter, a selector portion connected to the article portion for selecting a single crystal from a plurality of directionally solidifying crystals in any molten metal in the mold, and a starter portion having a first end connected to the selector portion and a second open end for allowing directional solidification of crystals in molten metal in the starter portion of the mold, the starter portion having a height in the range of 10 mm to 20 mm, the second subsection of the runner chamber being connected to the starter portion, the article portion having a central axis and an article chamber to define the desired component, the runner portion having a runner chamber to convey molten metal to the at least one article portion, the runner chamber including a first subsection and a second subsection, the first subsection having a central axis which is substantially parallel to, and spaced from, the central axis of the at least one article portion, the second subsection interconnecting the first subsection of the runner chamber and the at least one article portion, at least a part of the second subsection making an acute angle with any lien parallel to the central axis of the first subsection of the runner chamber or making an acute angle with any line parallel to the central axis of the at least one article portion, the at least one filter being positioned in the runner chamber such that nay molten metal flowing from the runner chamber to the article chamber flows through the at least one filter from the first subsection to the second subsection of the runner portion.

21. A ceramic shell mold for casting a single crystal component, comprising at least one article portion having an article chamber to define the desired component, the article portion having a central axis, a selector potion connected to the article portion for selecting a single crystal from a plurality of directionally solidifying crystals in molten metal in the mold, a starter portion having a first end connected to the selector portion and a second open end for allowing directional solidification of crystals in molten metal in the starter portion of the mold, the starter portion having a diameter int he range of 4 mm to 10 mm, a runner portion having a runner chamber to convey molten metal to the at least one article portion, the runner chamber including a first subsection having a central axis which is substantially parallel to, and spaced from, the central axis of the at least one article portion, and a second subsection interconnecting the first subsection of the runner chamber and the at least one article portion, the second subsection of the runner chamber being connected to the starter portion, at least a part of the second subsection making an acute angle with any lien parallel to the central axis of the first subsection of the runner chamber or making an acute angle with any lien parallel to the central axis of the at least one article portion to allow relative movement between the first subsection of the runner chamber and the at least one article portion.

22. A ceramic shell mold for casting a component, comprising at least one article portion, a runner portion, and at least one filter, the article having a central axis and an article chamber to define the desired component, the runner portion having a runner chamber to convey molten metal to the at least one article portion, the runner chamber including a first subsection and a second subsection, the first subsection and the second subsection being interconnected, the first subsection having a central axis which si substantially parallel to, and spaced from, the central axis of the at least one article portion, the second subsection extending in a curved line and interconnecting the first subsection of the runner chamber and the at least one article portion, at least a part of the second subsection making an acute angle with any line parallel to the central axis for the first subsection of the runner chamber or making an acute angle with any line parallel to the central axis of the at least one article portion, the interconnection between the second subsection of the runner chamber and the first subsection of the runner chamber and the interconnection between the second subsection of the runner chamber and the article portion being arranged such that at least one of the interconnections does not lie in a plane containing the central axis of the article portion and the central axis of the first subsection of the runner chamber; the at least one filter being positioned in the runner chamber such that any molten metal flowing from the runner chamber to the article chamber flows through the at least one filter from the first subsection to the second subsection of the runner portion.

* * * * *